US007870863B2

(12) United States Patent
Hedstrom et al.

(10) Patent No.: US 7,870,863 B2
(45) Date of Patent: Jan. 18, 2011

(54) MULTI-USE SUMP FOR A DRAWER-TYPE DISHWAHER

(75) Inventors: Kristen K. Hedstrom, Orlando, FL (US); Michael J. Kramer, Atlanta, GA (US); Mark E. Palm, Orlando, FL (US); Rodney M. Welch, Jackson, TN (US)

(73) Assignee: Maytag Corporation, Benton Harbor, MI (US)

( * ) Notice: Subject to any disclaimer, the term of this patent is extended or adjusted under 35 U.S.C. 154(b) by 1681 days.

(21) Appl. No.: 11/052,874

(22) Filed: Feb. 9, 2005

(65) Prior Publication Data

US 2006/0174923 A1 Aug. 10, 2006

(51) Int. Cl.
*B08B 3/02* (2006.01)

(52) U.S. Cl. ..... 134/104.2

(58) Field of Classification Search ..... 134/104.2
See application file for complete search history.

(56) References Cited

U.S. PATENT DOCUMENTS 3,750,951 A * 8/1973 Perl ..... 239/139
4,754,770 A * 7/1988 Fornasari ..... 134/57 D
5,470,142 A 11/1995 Sargeant et al.
5,651,380 A 7/1997 Sargeant et al.
5,651,382 A 7/1997 Sargeant et al.
5,709,237 A 1/1998 Sargeant et al.
5,743,281 A 4/1998 Sargeant et al.
5,755,244 A 5/1998 Sargeant et al.
5,762,080 A * 6/1998 Edwards et al. ..... 134/58 D
6,189,551 B1 2/2001 Sargeant
6,244,277 B1 6/2001 Maunsell
6,260,565 B1 7/2001 Welch et al.
6,294,767 B1 9/2001 Sargeant et al.
6,447,081 B1 9/2002 Sargeant et al.
6,460,555 B1 * 10/2002 Tuller et al. ..... 134/200
6,491,049 B1 12/2002 Tuller et al.
6,811,617 B2 * 11/2004 Elick et al. ..... 134/10
2003/0160000 A1 * 8/2003 Holland ..... 210/695
2003/0205246 A1 * 11/2003 Christman et al. ..... 134/18

* cited by examiner

*Primary Examiner*—Michael Cleveland
*Assistant Examiner*—Samuel A Waldbaum
(74) *Attorney, Agent, or Firm*—John W. Morrison; Diederiks & Whitelaw PLC

(57) ABSTRACT

A drawer-type dishwasher includes a frame assembly, a wash tub, a plurality of wash system components and a sump. The sump is either integrally formed with or separately formed and mounted to a bottom wall portion of the tub, while being provided with a plurality of fluid conduits that extend from a central intake ring to a respective plurality of attachment flanges. A wash pump and a drain pump are supported by respective ones of the plurality of attachment flanges so as to direct a flow of wash fluid into and out of the wash tub. The sump also includes structure for mounting a heater and a filter housing, as well as other wash and safety system components.

27 Claims, 5 Drawing Sheets

MULTI-USE SUMP FOR A DRAWER-TYPE DISHWAHER

BACKGROUND OF THE INVENTION

1. Field of the Invention

The present invention pertains to the art of dishwashers and, more particularly, to a drawer-type dishwasher including a wash tub having an formed multi-use sump.

2. Discussion of the Prior Art

In general, drawer-type dishwashers are known in the art. Typically, a drawer-type dishwasher will include a drawer or pull-out wash tub slidably mounted in a cabinet. A dish rack is provided within the wash tub to support dishware and the like during a washing operation. In some cases, the dishwasher will include first and second drawers or wash tubs arranged in an upper and lower configuration. However, regardless of the particular configuration, drawer-type dishwashers generally fall into two groups. In the first group, major wash system components, i.e., motors (wash and/or drain), heating elements, and filters are fixedly mounted relative to the cabinet. The drawer is provided with structure that is adapted to engage into corresponding structure on the frame so as to both fluidly and electrically interconnect the drawer with the major wash system components. In the second group, the major wash system components are mounted to the drawer.

When designing a dishwasher that falls into the second group, space is a critical concern, even more so in models that include upper and lower wash tubs. Towards that end, manufacturers have developed a variety of designs directed to minimizing an overall vertical height of the wash tub. In one configuration, a single motor is used to drive both a wash pump and a drain pump. In other configurations, the wash pump is actually an integral part of another, separate wash system component, for example, a wash arm. In any event, in order to decrease or otherwise minimize the vertical height of the wash tub, the overall number of major wash system components is typically reduced, along with the number of fluid conduits or passages that circulate the washing fluid throughout the tub. Regardless of the particular arrangement, the reduction in wash system components and fluid conduits, while achieving a desired decrease in vertical height, will limit the overall functionality of the dishwasher. That is, certain system components, such as heaters, filters and chopping blades typically found in larger units, cannot always be accommodated in more compact arrangements.

Based on the above, there exists a need in the art for a drawer-type dishwasher having all of the major wash system components typically found in larger, conventional dishwashers without increasing an overall vertical height of the wash tub. More specifically, there exists a need for a drawer-type dishwasher having an sump integrally formed with, or separately attached to, the tub, with the sump including mounting structure for supporting the major wash system components, as well as including fluid conduits for conducting a washing fluid into and out of the wash tub.

SUMMARY OF THE INVENTION

The present invention is directed to a drawer-type dishwasher including a drawer having side, rear and bottom walls that collectively define a wash tub, and a plurality of wash system components for selectively performing a washing operation. Preferably, the plurality of wash system components are mounted to a multi-use sump. More preferably, the multi-use sump includes a plurality of fluid conduits that are provided with a respective attachment flange for receiving particular ones of the wash system components.

In accordance with a preferred embodiment of the present invention, the plurality of wash system components include at least a wash pump and a drain pump. More specifically, the wash pump includes a wash pump housing having an inlet port, a wash fluid supply port and a wash fluid recirculation port. Preferably the supply and recirculation ports are each received by a respective one of the fluid conduits provided in the sump. Likewise, the drain pump includes a drain pump housing having a wash fluid inlet port secured to another one of the plurality of fluid conduits and an outlet port that leads to a drain hose. The plurality of wash system components also include a heating element for selectively heating the wash fluid and a filter for straining soil particles from the wash fluid during a wash operation.

In accordance with one embodiment of the present invention, the multi-use sump includes a heating element housing within which is arranged the heating element. More specifically, the heating element housing is fluidly connected to the supply port of the wash pump so as to heat the wash fluid entering the wash pump. In accordance with another embodiment of the present invention, the heating element is housed within one of the plurality of fluid conduits. More specifically, the heating element is positioned in the fluid conduit connected to the recirculation port of the wash pump. In yet another embodiment, the heating element is positioned below a fluid flow plate in the multi-use sump. In this manner, the heating element, when activated, will heat the washing fluid flowing out of the wash tub.

In order to increase washing performance, the dishwasher is provided with two distinct flows of washing fluid, i.e., a supply flow and a return or recirculation flow. In order to further increase wash performance, a filter housing is provided in the wash tub to trap soil particles entrapped in the washing fluid. Furthermore, the drain pump is provided with a chopping blade to mince the soil particles before expelling the washing fluid to a drain. In any event, the overall construction allows a vertical height of the wash tub to be maintained at a minimum level without sacrificing overall washing performance.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
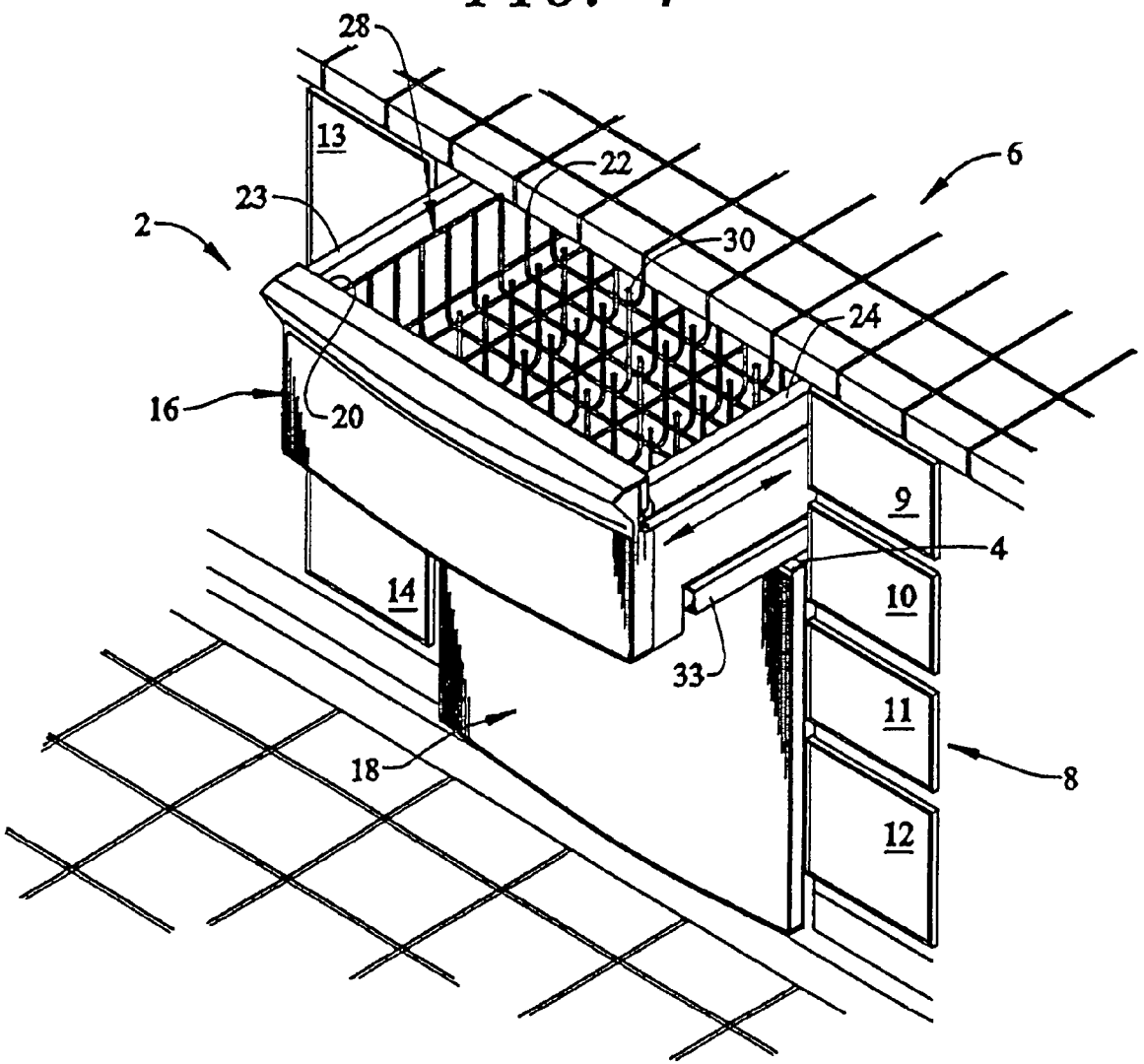
FIG. 1 is an upper right perspective view of a drawer-type dishwasher having a multi-use sump constructed in accordance with the present invention.
Figure 2:
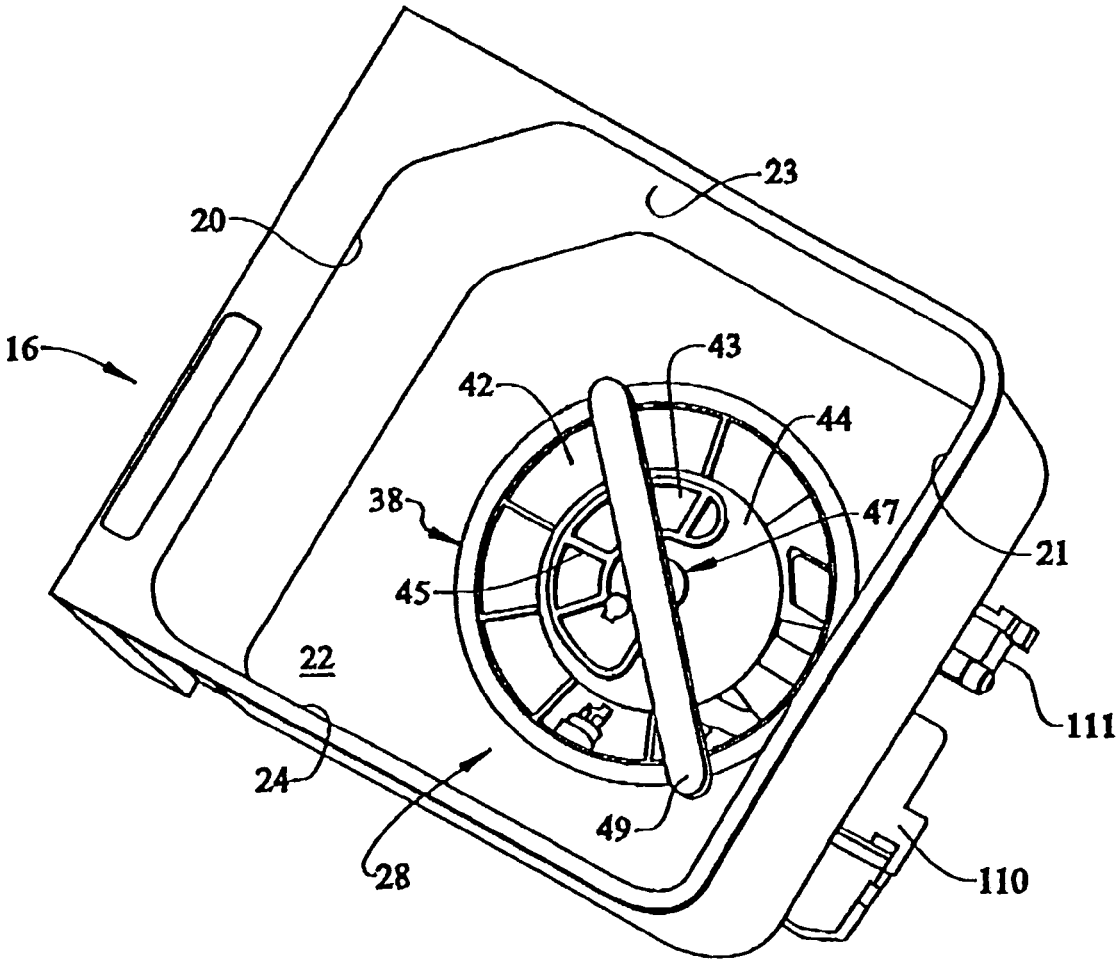
FIG. 2 is an upper perspective view of a wash tub of the dishwasher of FIG. 1.

With initial reference to FIGS. 1 and 2, a dishwasher constructed in accordance with the present invention is generally indicated at 2. As shown, dishwasher 2 includes a support frame 4 arranged below a kitchen countertop 6. Also below kitchen countertop 6 is shown cabinetry 8 including a plurality of drawers 9-12, as well as cabinet doors 13 and 14. Although the actual dishwasher into which the present invention may be incorporated can vary, the invention is shown in connection with dishwasher 2 depicted as a dual cavity dishwasher having an upper washing unit 16 and a lower washing unit 18. As best illustrated in FIG. 1, upper washing unit 16 takes the form of a slide-out drawer unit having a medium capacity so as to be sized to receive and wash smaller objects such as glassware, while lower cavity 18 is illustrated as a slide-out drawer having a larger capacity for kitchenware, cookware, and the like. Of course, it should be understood that upper and lower washing units 16 and 18 can be of similar size and construction.

In accordance with a preferred form of the invention, as shown in FIGS. 1 and 2, upper washing unit or drawer 16 includes a front wall 20, rear wall 21, bottom wall 22 and opposing side walls 23 and 24 that collectively define an upper wash tub or basin 28. In a manner known in the art, upper wash tub 28 is provided with a dish rack 30 for supporting various objects, such as dishware, glassware, and the like, that are exposed to a washing operation. Upper washing unit 16 is slidingly supported within support frame 4 through a pair of drawer support guides, one of which is indicated at 33.

As best shown in FIG. 2, a main filter housing 38 is provided on bottom wall 22 within wash tub 28. Main filter housing 38 is actually positioned within a central, generally U-shaped, intake ring 40 (see FIG. 3) formed in bottom wall 22. In any event, main filter housing 38 includes a coarse or first radial strainer 42, a fine or second radial strainer 43 and a cover 44. Actually, second radial strainer 43 is part of a fine particle filter chamber (not shown) including a fine mesh filter screen (not separately labeled) provided within each of a plurality of large radial spaced openings 45 arranged about cover 44. First radial strainer 42 leads to a flow plate 46 (see FIG. 5) which, as will be discussed more fully below, guides or directs washing fluid toward additional wash system components. A hub member 47 extends through cover 44 and serves as a support for a wash arm 49. As will be discussed more fully below, wash arm 49 directs a flow of washing fluid onto kitchenware placed within wash tub 28. In general, the structure described above with respect to dishwasher 2 does not constitute particular aspects of the present invention. Therefore, this structure has only been described for the sake of completeness. Instead, the present invention is particularly directed to a multi-use sump that can be integrally formed with, or separately mounted to, bottom wall 22 of wash tub 28 as will be detailed fully below.

Figure 3:
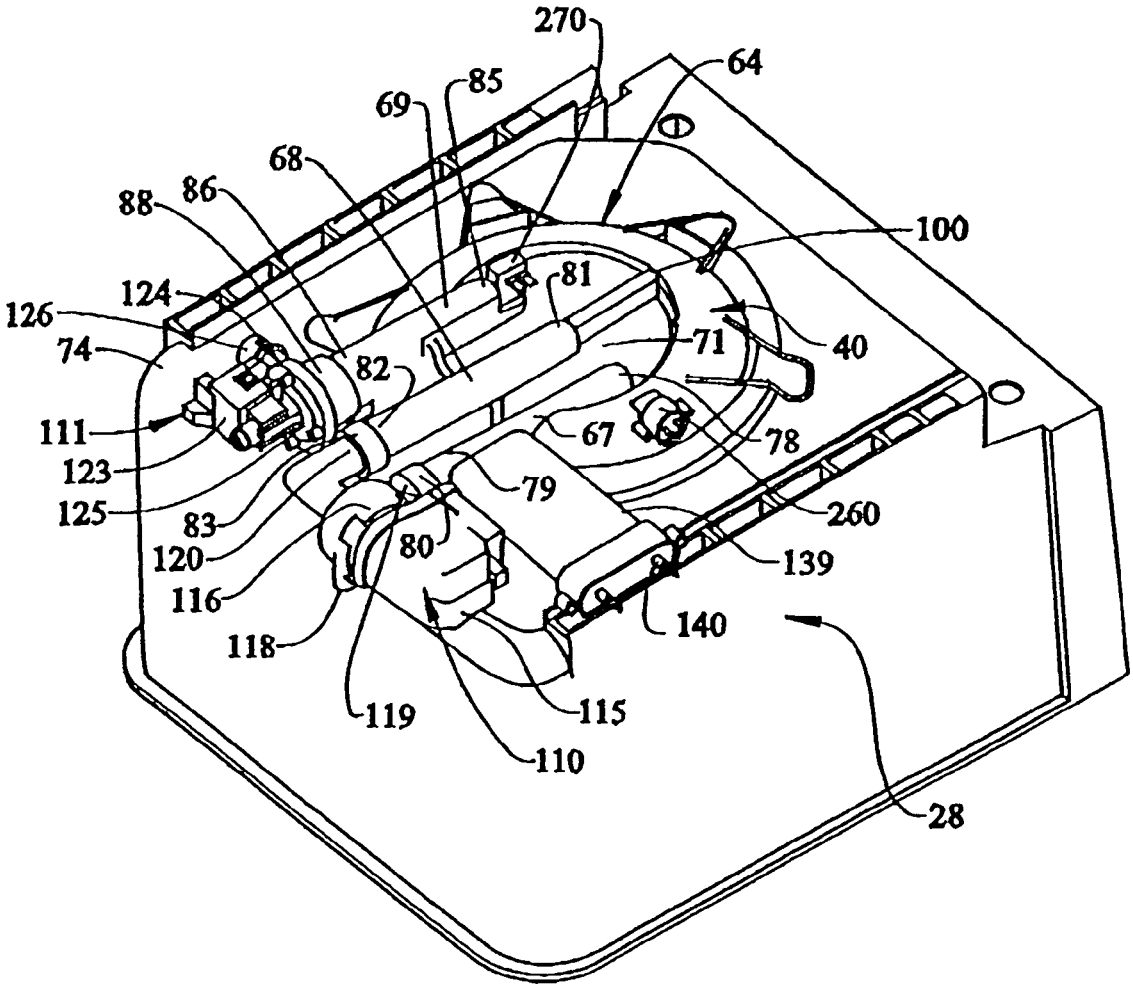
FIG. 3 is a lower perspective view of the tub of FIG. 2 illustrating one embodiment of the present invention with the integrally formed multi-use sump including a heating element housing.

With particular reference to FIG. 3, a multi-use sump 64 includes a plurality of fluid conduits 67-69 formed along bottom wall 22 of wash tub 28. In accordance with a preferred form of the invention, fluid conduit 67 constitutes a wash fluid supply conduit, fluid conduit 68 constitutes a wash fluid recirculation conduit, and fluid conduit 69 constitutes a wash fluid drain conduit so that each of fluid conduits 67-69 provide washing fluid flow management during various portions of a washing operation. Preferably, fluid conduits 67-69 are spaced from one another across bottom wall 22 and extend from within a central portion 71 of intake ring 40 to an outer edge portion 74 of wash tub 28. In the embodiment shown, fluid conduits 67-69 are arranged substantially parallel one another. However, other arrangements could also be employed. More specifically, supply conduit 67 includes a first end 78, fluidly connected to wash arm 49, leading to a second end 79. Second end 79 is provided with an attachment flange 80. Likewise, recirculation conduit 68 extends from a first end 81 positioned centrally within intake ring 40 to a second end 82. In a manner corresponding to supply conduit 67, recirculation conduit 68 is provided with an attachment flange 83. Finally, drain conduit 69 extends from a first end 85 that is in fluid communication with main filter housing 38 to a second end 86 which is also provided with an attachment flange 88. Multi-use sump 64 also includes a drain channel 100 that extends between first end 81 of fluid conduit 68 and intake ring 40. Drain channel 100 is provided to decrease the time required to perform a drain operation.

In addition to managing the flow of washing fluid in dishwasher 2, multi-use sump 64 serves as a mounting platform for a plurality of wash system components. As best shown in FIG. 3, a wash pump 110 and a drain pump 111 are mounted to tub 28 along outer edge portion 74. Preferably, wash pump 110 includes a wash motor housing 115 and a wash pump housing 116. More preferably, wash pump housing 116 includes a fresh water inlet 118, a supply outlet 119 for directing washing fluid to wash arm 49 and a recirculation inlet 120 that conducts wash fluid back from tub 28 to wash pump housing 116 where the wash fluid is once again directed to wash arm 49. Toward that end, wash pump housing 116 is generally F-shaped with supply outlet 119 and recirculation outlet 120 projecting into attachment flanges 80 and 83 of supply and recirculation conduits 67 and 68 respectively.

With this arrangement a substantially closed loop recirculation system is formed with wash tub 28. That is, washing fluid passing through first radial strainer 42 onto flow plate 46 is guided toward recirculating conduit 68 and, during portions of the wash cycle, to drain conduit 69. Likewise, drain pump 111 includes a drain motor housing 123 and a drain pump housing 124. Drain pump housing 124 includes an inlet port 125 and an outlet port 126 adapted to interconnected to a drain hose (not shown). Inlet port 125 is preferably provided with a chopping mechanism (not shown) for macerating food particles before being expelled with the wash fluid from wash tub 28 during periodic drain or purging operations.

In accordance with one preferred embodiment of the invention, multi-use sump 64 includes a heater housing 139 within which is provided a heating element 140. In the embodiment illustrated in FIG. 3, heater housing 139 is in fluid communication with supply conduit 67 so that, during select portions of a washing operation, heating element 140 can be used to selectively elevate a temperature of the wash fluid entering wash tub 28.

Figure 4:
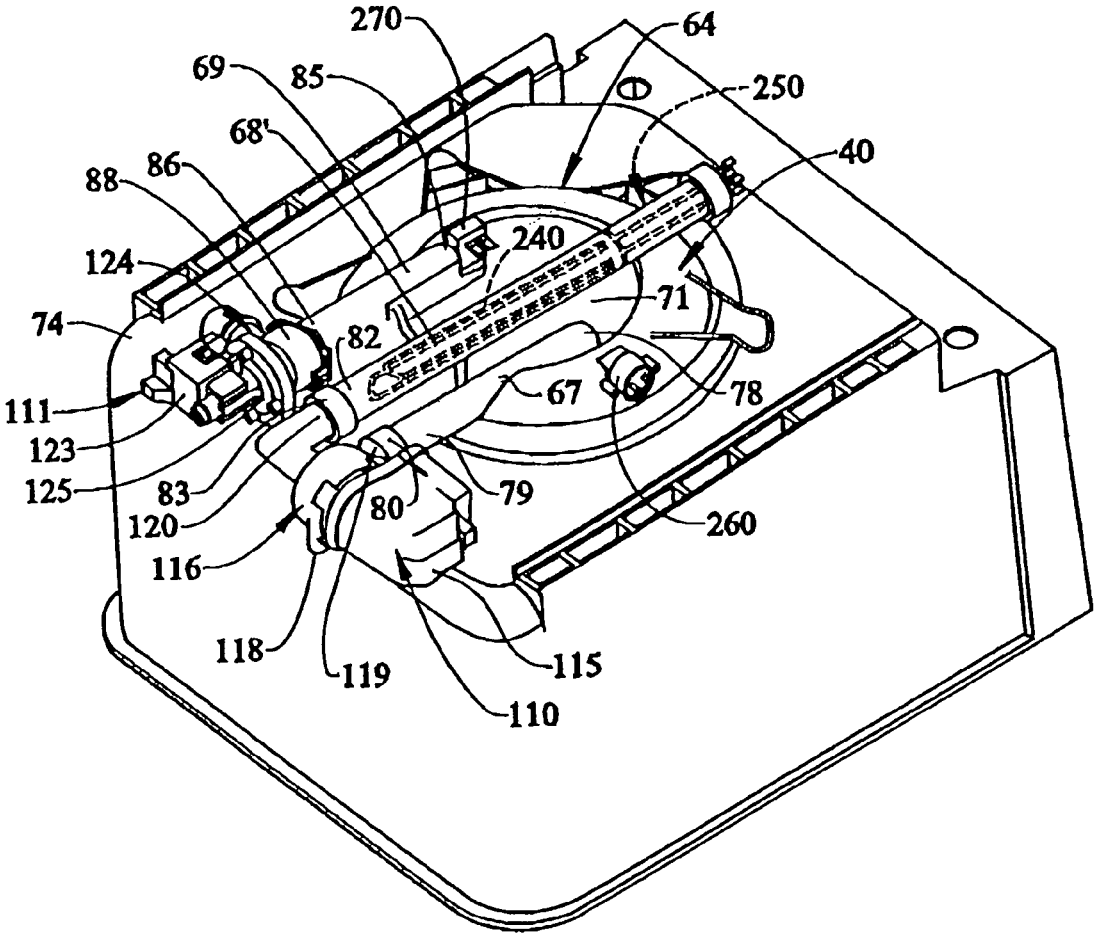
FIG. 4 is a lower perspective view of a wash tub having a multi-use sump constructed in accordance with a second embodiment of the present invention showing a heating element positioned in a fluid conduit.

In accordance with another preferred embodiment illustrated in FIG. 4, to further conserve space and particularly vertical height, a heating element 240 is mounted within a recirculation conduit 68' that extends from a front portion (not labeled) of intake ring 40 to second end 82. Recirculation conduit 68' is provided with an inlet (not shown) arranged centrally within intake ring 40 that receives a flow of washing fluid from main filter housing 38. With this particular arrangement, the need for additional structure, such as housing 139, can be eliminated while still providing a means to heat the wash fluid. That is, in accordance with the embodiment shown, wash fluid flowing from wash tub 28 through recirculation conduit 68 can be heated by selectively activating heating element 240 which is submerged. In accordance with one aspect of the present embodiment, heating element 240 includes an unheated portion 250 arranged to bridge at least a portion of multi-use sump 64 adjacent to second radial strainer 43. In any event, the particular construction and arrangement of multi-use sump 64 contributes to forming a wash tub 28 with a minimal vertical height without sacrificing washing operation performance.

Figure 5:
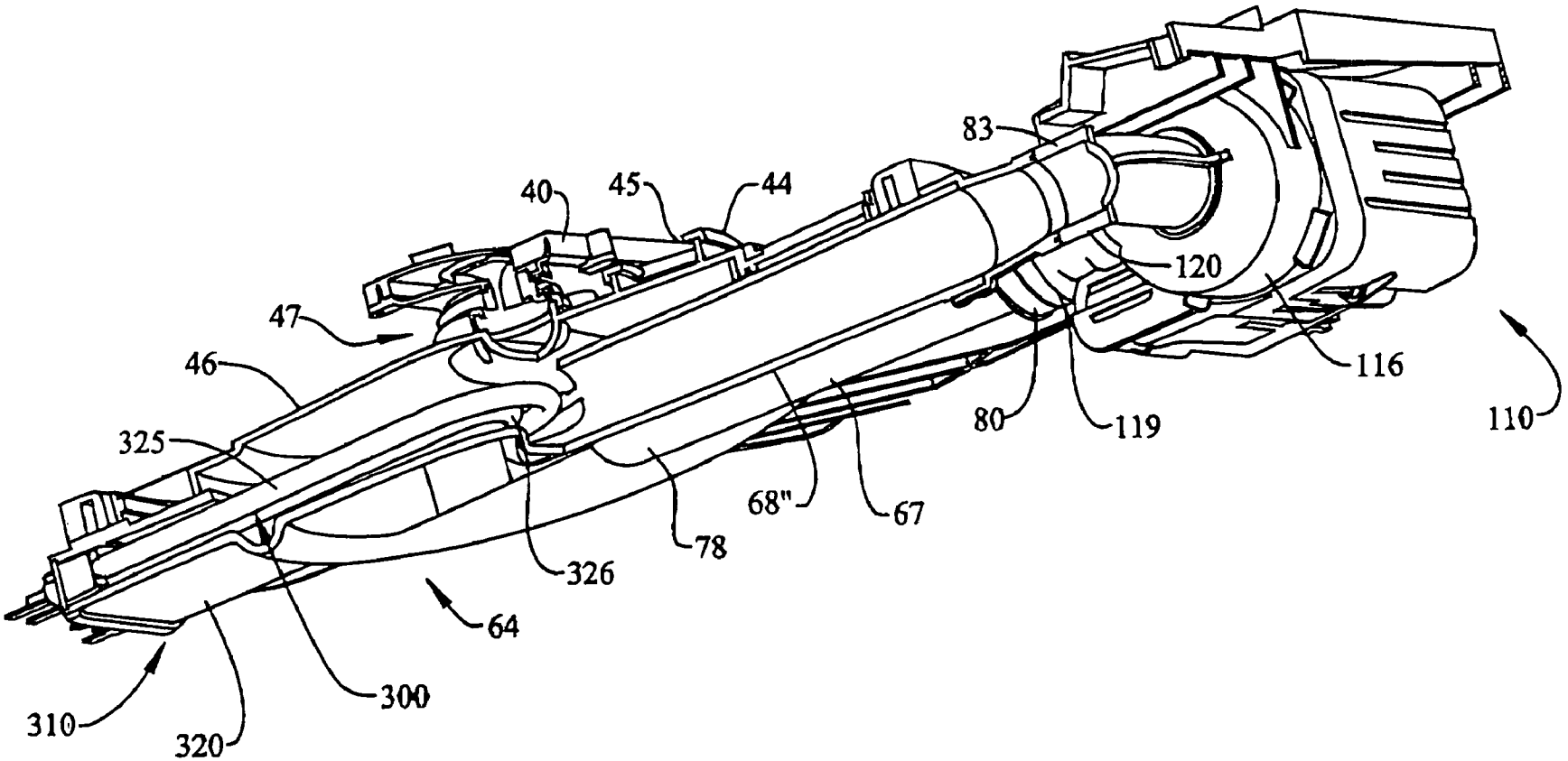
FIG. 5 is a partial, cross-sectional view illustrating a third embodiment of the present invention showing a heating element positioned below a fluid flow plate of the sump.

In accordance with the preferred embodiment illustrated in FIG. 5, a heating unit 300 is mounted within a housing 310 that is fluidly connected to recirculation conduit 68". Housing 310 is defined by flow plate 46 and a bottom wall (not separately labeled) of sump 64. This particular configuration serves to even further conserve space, particularly vertical height, without detracting from the overall capacity of wash tub 16. In any event, heating unit 300 is shown to include first and second heating elements 325 and 326 which can be operated either singly or in combination to heat the washing fluid passing through recirculation conduit 68". In general, the multi-use sump 64 of the present invention enables the construction of a drawer-type dishwasher that includes many of the advantageous features of larger dishwashers, such as multi-stage filtering, wash fluid flow management, food choppers and the like without increasing an overall vertical height of the wash tub. Furthermore, the multi-use sump 64 simplifies the overall assembly process for dishwasher 2. In addition, multi-use sump 64 can be provided with a turbidity sensor 260 and/or a solenoid 270 to control or activate other advantageous washing operations.

Although described with reference to a preferred embodiment of the present invention, it should be readily apparent to one of ordinary skill in the art that various changes and/or modifications can be made to the invention without departing from the spirit thereof. For instance, in addition to the wash system components described above, multi-use sump 64 can also be provided with various other sensors and/or safety devices, such as a heat shield and power interrupt components for the heater. In addition, while various components, such as the filter assembly and conduits, are described as being formed in bottom wall 22, they can also be provided as separate components. In general, the invention is only intended to be limited by the scope of the following claims.

We claim:

1. A dishwasher comprising:

a frame assembly;

a wash tub including side, rear and bottom walls, said wash tub being slidingly mounted in the frame assembly so as to define a drawer of the dishwasher;

a spray arm rotatably mounted within the wash tub;

an intake ring in the bottom wall of the wash tub;

a plurality of wash system components for selectively performing a washing operation in the wash tub; and a multi-use sump provided at the bottom wall of the wash tub, said multi-use sump including a plurality of integrally formed fluid conduits extending from the intake ring along the bottom wall, each of said plurality of fluid conduits including a respective attachment flange for connecting a respective one of the plurality of wash system components wherein, during the washing operation, the plurality of fluid conduits manage a flow of washing fluid between the plurality of wash system components and the wash tub.

2. The dishwasher according to claim 1, wherein the plurality of fluid conduits are spaced from one another about the bottom wall of the wash tub.

3. The dishwasher according to claim 2, wherein each of the plurality of fluid conduits are positioned substantially parallel to one another along the bottom wall of the wash tub.

4. The dishwasher according to claim 1, wherein the plurality of fluid conduits include a supply conduit, a recirculation conduit and a drain conduit.

5. The dishwasher according to claim 4, wherein each of the supply, recirculation and drain conduits extend from the intake ring outward so as to locate the plurality of wash system components outside the intake ring.

6. The dishwasher according to claim 4, wherein the spray arm is in fluid communication with the supply conduit.

7. The dishwasher according to claim 4, wherein the recirculation conduit is interposed between the supply and drain conduits.

8. The dishwasher according to claim 4, wherein the plurality of wash system components includes a wash pump having a wash pump housing including an inlet port, a supply port and a recirculation port, said supply port being connected to the attachment flange of the supply conduit and the recirculation port being connected to the attachment flange of the recirculation port.

9. The dishwasher according to claim 4, wherein the plurality of wash system components includes a heating element.

10. The dishwasher according to claim 9, wherein the multi-use sump includes a heating element housing fluidly connected to the supply conduit, said heating element being mounted in the heating element housing for selectively heating a flow of washing fluid entering the wash tub.

11. The dishwasher according to claim 10, wherein a portion of the heating element in the recirculation conduit is unheated.

12. The dishwasher according to claim 9, wherein the heating element is positioned in the recirculation conduit.

13. The dishwasher according to claim 9, wherein the heating element is mounted in a housing positioned below the bottom wall of the wash tub, said heating element being in fluid communication with the recirculation conduit.

14. The dishwasher according to claim 4, wherein the plurality of wash system components includes a drain pump having a drain pump housing including an inlet port and an outlet port, said inlet port being connected to the attachment flange of the drain conduit.

15. The dishwasher according to claim 1, wherein the multi-use sump is integrally formed in the bottom wall of the wash tub.

16. The dishwasher according to claim 1, wherein the multi-use sump is separately formed from and mounted to the wash tub.

17. A dishwasher comprising:

a frame assembly;

a drawer slidingly mounted in the frame assembly, said drawer including side, rear and bottom walls that collectively define a wash tub;

a spray arm rotatably mounted within the wash tub;

an intake ring provided in the bottom wall of the drawer;

a plurality of wash system components for selectively performing a washing operation in the wash tub; and conduit means provided on the bottom wall, said conduit means managing a plurality of washing fluid flows between each of the plurality of wash system components and the wash tub.

18. The dishwasher according to claim 17, wherein the conduit means includes attachment flanges adapted to connect to respective ones of the plurality of wash system components.

19. The dishwasher according to claim 17, wherein the conduit means includes a supply conduit, a recirculation conduit and a drain conduit, each of said supply, recirculation and drain conduits extending from the intake ring to the rear wall of the tub.

20. The dishwasher according to claim 19, wherein the supply, recirculation and drain conduits are spaced and arranged substantially parallel to one another along the bottom wall.

21. The dishwasher according to claim 20, wherein the recirculation conduit is interposed between the supply and drain conduits.

22. The dishwasher according to claim 17, wherein the conduit means is integrally formed with the bottom wall of the wash tub.

23. The dishwasher according to claim 17, wherein the conduit means is provided as part of a sump which is separately formed from and attached to the bottom wall.

24. The dishwasher according to claim 17, wherein the plurality of wash system components includes a heating element.

25. The dishwasher according to claim 24, wherein the wash tub includes a heating element housing fluidly connected to a supply conduit of the conduit means, said heating element being mounted in the heating element housing for selectively heating a flow of washing fluid entering the wash tub.

26. The dishwasher according to claim 24, wherein the heating element is positioned in a recirculation conduit of the conduit means, said heating element being adapted to selectively heat a flow of washing fluid exiting the wash tub.

27. The dishwasher according to claim 26, further comprising: a filter housing exposed within the wash tub, wherein a portion of the heating element in the recirculation conduit is an unheated portion, said unheated portion being directly adjacent to the filter housing.

* * * * *